US009931016B2

(12) United States Patent
Rockwell

(10) Patent No.: US 9,931,016 B2
(45) Date of Patent: Apr. 3, 2018

(54) DISHWASHER INSULATION BLANKET

(71) Applicant: Owens Corning Intellectual Capital, LLC, Toledo, OH (US)

(72) Inventor: Anthony L. Rockwell, Pickerington, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 214 days.

(21) Appl. No.: 14/509,095

(22) Filed: Oct. 8, 2014

(65) Prior Publication Data

US 2015/0097472 A1 Apr. 9, 2015

Related U.S. Application Data

(60) Provisional application No. 61/888,955, filed on Oct. 9, 2013.

(51) Int. Cl.
*A47L 15/42* (2006.01)

(52) U.S. Cl.
CPC ..... *A47L 15/4209* (2016.11); *A47L 15/4246* (2013.01)

(58) Field of Classification Search
None
See application file for complete search history.

(56) References Cited

U.S. PATENT DOCUMENTS 4,131,664 A 12/1978 Flowers et al.
5,660,915 A 8/1997 Schopes et al.
5,855,353 A 1/1999 Shaffer et al.
5,968,851 A 10/1999 Herreman et al.
6,196,029 B1 3/2001 Melia et al.
6,228,785 B1 5/2001 Miller et al.
6,539,955 B1 * 4/2003 Tilton ..... A47L 15/4255 134/191
6,726,980 B2 4/2004 Staelgraeve et al.
6,807,700 B2 10/2004 Panther et al.
6,893,711 B2 5/2005 Williamson et al.
7,128,561 B2 10/2006 Rockwell et al.
7,159,836 B2 1/2007 Parks et al.
7,226,879 B2 6/2007 Tilton et al.
7,357,974 B2 4/2008 Rockwell
7,500,541 B2 3/2009 Schmidt et al.
7,748,796 B2 7/2010 Rockwell et al.
7,827,753 B2 11/2010 Nagarajan et al.
7,837,009 B2 11/2010 Gross et al.
D629,556 S 12/2010 Alter et al.
(Continued)

FOREIGN PATENT DOCUMENTS

EP 590629 2/1997
EP 1182087 2/2002
(Continued)

*Primary Examiner* — Jason Ko
*Assistant Examiner* — Cristi Tate-Sims
(74) *Attorney, Agent, or Firm* — Calfee, Halter & Griswold LLP

(57) ABSTRACT

A dishwasher includes a tub with a sidewall. A vent is attached to the sidewall of the tub. An inlet line is disposed outside the sidewall and is attached to the vent. The inlet line provides water to the tub through the sidewall. An insulation blanket is disposed over the tub sidewall and the vent. A water vapor path extends from the vent to at least an edge of the insulation blanket.

16 Claims, 15 Drawing Sheets

(56) References Cited

U.S. PATENT DOCUMENTS

| | | | | |
|---|---|---|---|---|
| 7,918,313 | B2 * | 4/2011 | Gross | D04H 13/006 181/284 |
| 7,923,092 | B2 | 4/2011 | Rockwell | |
| 8,303,726 | B2 * | 11/2012 | Beaudet | A47L 15/4293 134/56 D |
| 2003/0176131 | A1 | 9/2003 | Tilton | |
| 2005/0191921 | A1 | 9/2005 | Tilton et al. | |
| 2006/0065482 | A1 | 3/2006 | Schmidft et al. | |
| 2006/0231122 | A1 * | 10/2006 | Stelzer | A47L 15/486 134/18 |
| 2006/0008614 | A1 | 12/2006 | Rockwell et al. | |
| 2006/0008616 | A1 | 12/2006 | Dean et al. | |
| 2007/0054090 | A1 | 3/2007 | Rockwell | |
| 2007/0212970 | A1 | 9/2007 | Rockwell et al. | |
| 2007/0243366 | A1 | 10/2007 | Tilton et al. | |
| 2007/0272285 | A1 | 11/2007 | Herreman et al. | |
| 2008/0145630 | A1 | 6/2008 | Rockwell | |
| 2008/0289664 | A1 | 11/2008 | Rockwell et al. | |
| 2008/0317996 | A1 | 12/2008 | Rockwell | |
| 2009/0038980 | A1 | 2/2009 | Rockwell et al. | |
| 2009/0094908 | A1 | 4/2009 | Krueger et al. | |
| 2009/0277485 | A1 * | 11/2009 | Haltmayer | A47L 15/4217 134/56 D |
| 2009/0301022 | A1 | 12/2009 | Rockwell et al. | |
| 2010/0024851 | A1 | 2/2010 | Rockwell et al. | |
| 2010/0147621 | A1 | 6/2010 | Gillette | |
| 2011/0069498 | A1 | 3/2011 | Alter et al. | |
| 2011/0086214 | A1 | 4/2011 | Rockwell | |
| 2011/0233086 | A1 | 9/2011 | Rockwell et al. | |
| 2012/0169194 | A1 | 7/2012 | Maderic et al. | |
| 2012/0200210 | A1 | 8/2012 | Rockwell | |
| 2012/0298154 | A1 | 11/2012 | Rockwell et al. | |
| 2013/0174435 | A1 | 6/2013 | Rockwell et al. | |
| 2013/0266787 | A1 | 10/2013 | Rockwell et al. | |
| 2013/0337205 | A1 | 12/2013 | Rockwell et al. | |
| 2014/0230497 | A1 | 8/2014 | Rockwell et al. | |
| 2015/0218803 | A1 | 8/2015 | Rockwell | |
| 2015/0233110 | A1 | 8/2015 | Alter et al. | |
| 2015/0250375 | A1 | 9/2015 | Rockwell et al. | |
| 2015/0368852 | A1 | 12/2015 | Rockwell et al. | |

FOREIGN PATENT DOCUMENTS

| | | | | |
|---|---|---|---|---|
| JP | 2000345680 A | * | 12/2000 | E04F 13/08 |
| KR | 20130122030 | | 11/2013 | |
| WO | 94/011556 | | 5/1994 | |
| WO | 06/107847 | | 10/2006 | |

* cited by examiner

DISHWASHER INSULATION BLANKET

RELATED APPLICATIONS

The present application claims the benefit of U.S. Provisional Patent Application No. 61/888,955, filed on Oct. 9, 2013, the entire disclosure of which is incorporated herein by reference.

FIELD OF INVENTION

The present invention relates generally to the field of dishwashers and more particularly to the insulation blankets for dishwashers.

BACKGROUND

Various types of dishwashers have been utilized in the domestic and commercial industries. The technology used to operate the dishwashers has largely remained consistent over the past few years. Although dishwashers vary in size and shape, their function is consistent; dishes inside the dishwasher are cleaned by water which is heated to sanitizing temperatures. Dishwashers may also include an option to add detergents to the wash cycle as well as an option to add a drying cycle at the end of the wash cycle.

Typically, a dishwasher has a tub with an interior surface and an exterior surface. Water is supplied to and removed from the interior surface of the tub by a pump assembly. The water may be supplied through a manifold that vents to the inside of the tub. The water supplied is heated to a predetermined sanitizing temperature by utilizing either an in line heater within the pump assembly or a heating element disposed inside the tub. For example, in many traditional dishwashers, the heating element is a heating coil. The heating element may also be utilized to heat the air inside the tub, which also assists in the drying of contents within the tub.

Appliances, such as dishwashers, washers, dryers and other machines that generate noise are usually provided with acoustical insulation to reduce the levels of sound emanating from the machines. The unwanted sound from these machines can be caused both by the mechanical operation of the motor within the machine and by the vibration of the machine itself. In a residential dwelling, excessive noise may be generated by dishwashers, clothes washers and clothes dryers, which can be annoying to inhabitants of the dwelling.

Conventional acoustical treatments for machines generally comprises sound transmission barriers and sound absorption layers. One form of acoustical insulation involves enclosing the noise source in an insulation structure. A typical form of acoustical insulation is a layer of mineral fiber insulation, such as fiberglass insulation, wrapped around or positioned around the source of unwanted noise. For example, a fiberglass absorber is usually incorporated in the front door panel of an under-the-counter dishwasher. The blanket of glass fibers absorbs some of the sound energy entering the fiberglass board, thereby resulting in a reduced transmission of unwanted sound from the source of sound in the appliance. Further, it is known that the insertion of a reflecting sound barrier within the acoustical insulation also reduces the sound transmission through the insulation product. Reflecting sound barriers in the past have been made of paper and also of a thin layer of polymeric material, as well as of other materials such as asphalt. U.S. Pat. No. 5,094,318 to Maeda et al. discloses a sound absorption material for automobiles which includes a damping layer, which may act as a sound reflection barrier, a sound absorption layer which absorbs acoustical energy, and a surfacing materiel. The damping layer can be purely asphalt, or an asphalt modified with resins and polymers. The sound absorption layer can be a foamed material or a fibrous material such as a mineral fiber blanket. U.S. Pat. No. 5,965,851 to Herreman et al. discloses an accoustically insulated apparatus, such as a dishwasher or a washing machine. U.S. Pat. No. 5,965,851 to Herreann et al. is incorporated herein by reference in its entirety.

SUMMARY

The present application discloses exemplary embodiments of a dishwasher and dishwasher installation. In one exemplary embodiment, the dishwasher includes a tub with a sidewall. A vent is attached to the sidewall of the tub. An inlet line is disposed outside the sidewall and is attached to the vent. The inlet line provides water to the tub through the sidewall. An insulation blanket is disposed over the tub sidewall and the vent. A water vapor path extends from the vent to at least an edge of the insulation blanket.

Further advantages and benefits will become apparent to those skilled in the art after considering the following description and appended claims in conjunction with the accompanying drawings.

BRIEF DESCRIPTION OF THE SEVERAL VIEWS OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION

The embodiments disclosed herein will now be described by reference to some more detailed embodiments, in view of the accompanying drawings. These embodiments may, however, be embodied in different forms and should not be construed as limited to the embodiments set forth herein. Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which these embodiments belong. The terminology used in the description herein is for describing particular embodiments only and is not intended to be limiting of the embodiments. As used in the specification and the appended claims, the singular forms "a," "an," and "the" are intended to include the plural forms as well, unless the context clearly indicates otherwise. All publications, patent applications, patents, and other references mentioned herein are incorporated by reference in their entirety.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Every numerical range given throughout this specification and claims will include every narrower numerical range that falls within such broader numerical range, as if such narrower numerical ranges were all expressly written herein.

Figure 1:
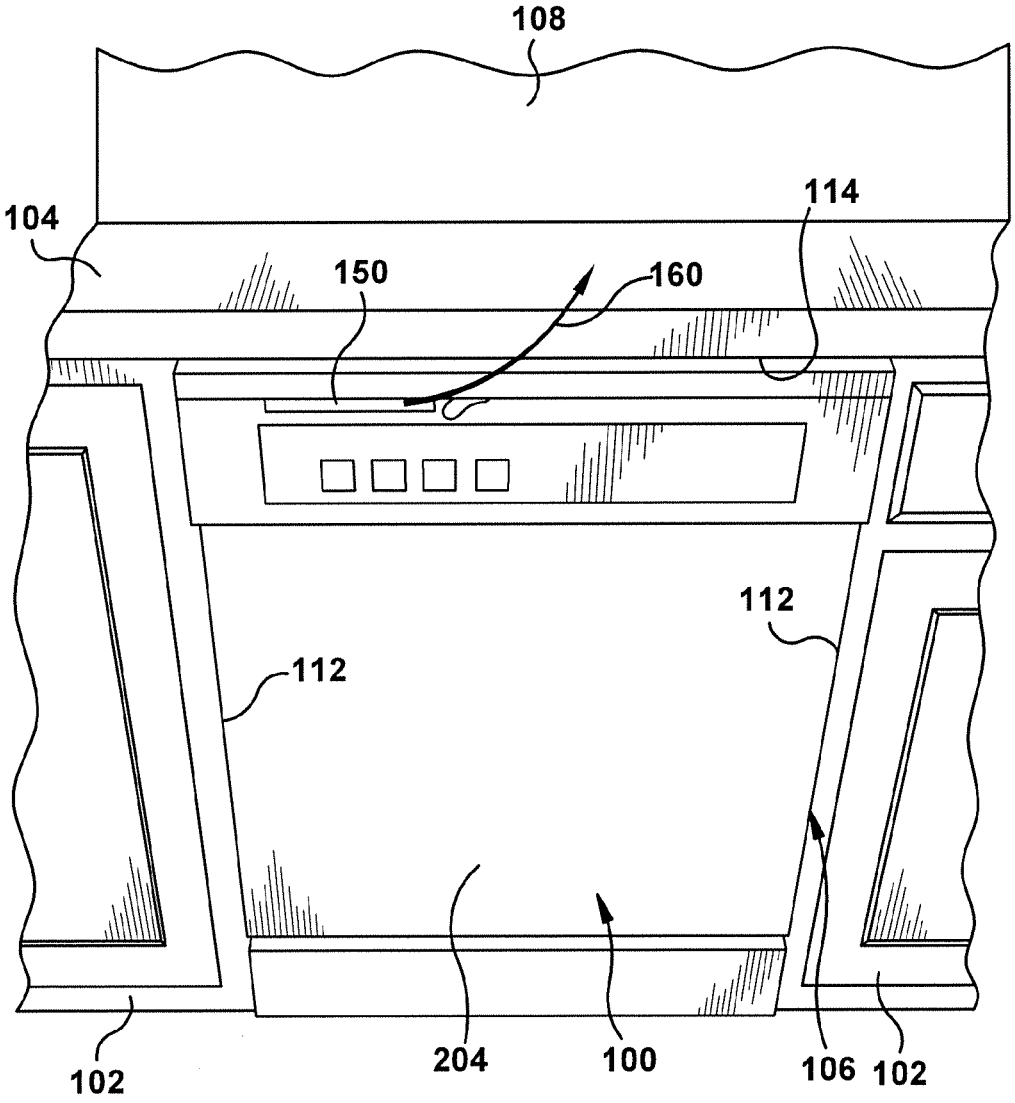
FIG. 1 shows a front view of a dishwasher installed in a cabinet under a countertop.
Figure 2:
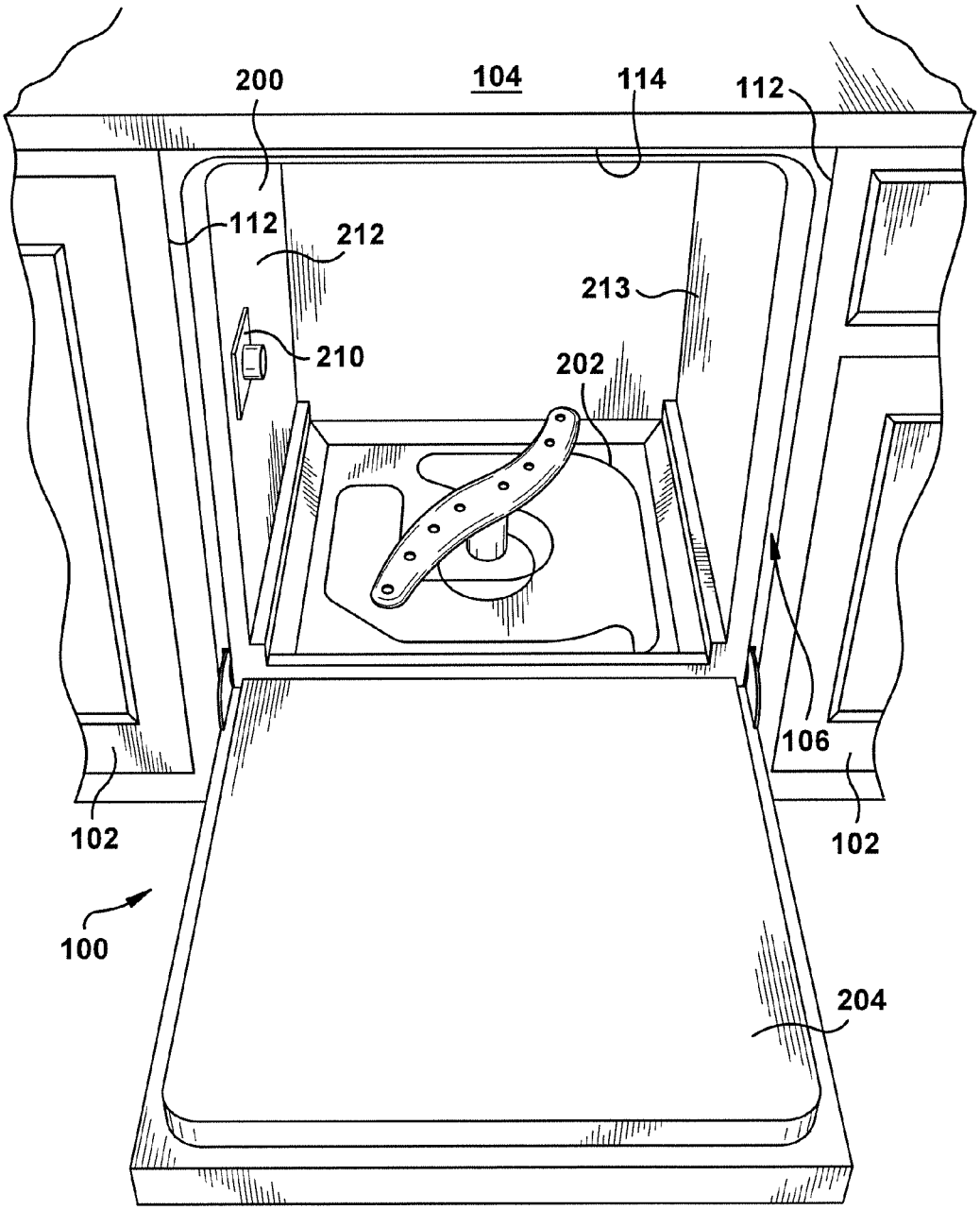
FIG. 2 shows a front view of a dishwasher with the front door opened.

FIG. 1 illustrates a dishwasher 100 installed between cabinets 102 and under a countertop 104. As such, a cavity 106 that the dishwasher is installed in is bounded by sides 112 of the cabinets 102, by the bottom 114 of the countertop 104, and by a wall 108 of the kitchen (see also FIGS. 7 and 8). FIG. 2 illustrates the dishwasher 100 with a door 204 open. The dishwasher includes a heating element 202, a tub 200, and the door 204.

Figure 3:
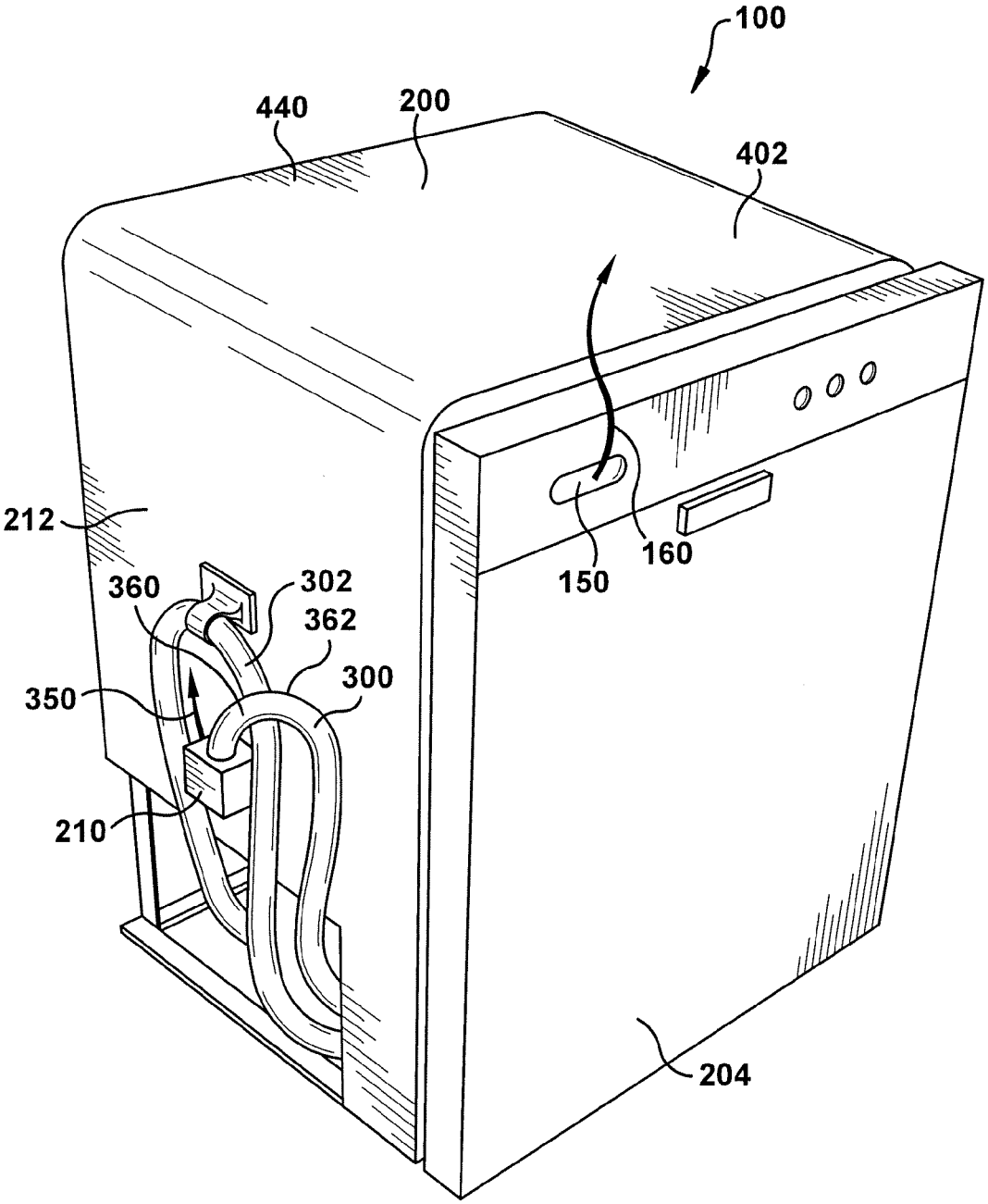
FIG. 3 shows a dishwasher without an insulation blanket removed from a cabinet and countertop.

In the example illustrated by FIGS. 2 and 3, a vent 210 is disposed in a sidewall 212 of the tub 200. In an exemplary embodiment, the vent 210 is connected to an inlet line 300 and/or to a drain line 302. The inlet line 300 fills the tub with water through the vent 210. The drain line 302 drains washwater from the tub 200. The vent 210 provides a path from the inlet line 300 and/or the drain line 302 into the tub 200. The vent 210 can take a wide variety of different forms. In one exemplary embodiment, the vent 210 provides an air gap that prevents backflow of water inside the dishwasher back into the water supply. For example, the air gap may be provided by a drop or discontinuity between the point where the water enters the vent 210 and a point where the water enters the dishwasher. In an exemplary embodiment, a body of the vent 210 is not sealed, such that water to the vent side 360 of a peak 362 of the inlet line drains through the vent 210 and into the tub 200, whenever the inlet line is shut off, thereby eliminating any chance of backflow.

In an exemplary embodiment, the dishwasher 100 also includes an exhaust vent 150. The exhaust vent 150 allows gas, such as water vapor that forms when water is heated in the washing and drying cycles of the dishwasher, to exit the dishwasher 100 as indicated by arrow 160. The exhaust vent can take a wide variety of different forms. The exhaust vent 150 can be through the door 204 as illustrated, but could be provided at other locations on the dishwasher. The vent 150 can take any conventional form.

Referring to FIG. 3, in one exemplary embodiment, the vent 210 allows gas to communicate from inside the tub 200, to outside the tub, through the vent 210 as indicated by arrow 350. Water inside the dishwasher 100 is vaporized inside the tub when the water is heated, for example during the wash cycle (i.e. during a regular wash cycle and/or during a sani-wash cycle) and/or during a drying cycle. In an exemplary embodiment, water vaporized by the heat (i.e. steam) can flow out of not only the exhaust vent 150, but also through the vent 210, such as through the unsealed body of the vent as indicated by arrow 350.

In one exemplary embodiment, an insulation blanket 400 is provided over a top 402 and on sidewalls 212, 213 of the tub 200. The insulation blanket 400 can be made from a wide variety of different materials. Examples of suitable materials include, but are not limited to, a non-woven synthetic material, a non-woven natural material and mixtures thereof. The material may include thermoplastic fiber material, thermosetting fiber material, bi-component fiber material and mixtures thereof. Various polymers are particularly useful in the present invention. Still more specifically the material may be selected from a group consisting of polyolefin, polypropylene, polyethylene, polyester, nylon, rayon, polyethylene terephthalate, polybutylene terephthalate, cotton, kenaf, silk, cellulose, hemp, shoddy, fiberglass, and mixtures thereof.

The insulation blanket can have a wide variety of different configurations. For instance, the blanket 400 illustrated by FIG. 4 leaves a rear portion 440 of the tub 200 exposed in the cavity 106 and the blanket 400 illustrated by FIG. 15 covers substantially all of the rear portion of the tub. In other embodiments, separate blankets 400 may be provided on the sidewalls 212, 213 of the tub 200, with no blanket provided on top of the dishwasher or a different material provided on top of the dishwasher. In an exemplary embodiment, the blanket 400 is configured to be somewhat compressed between the sides 112 of the cabinets 102 and the tub 200

Figure 4:
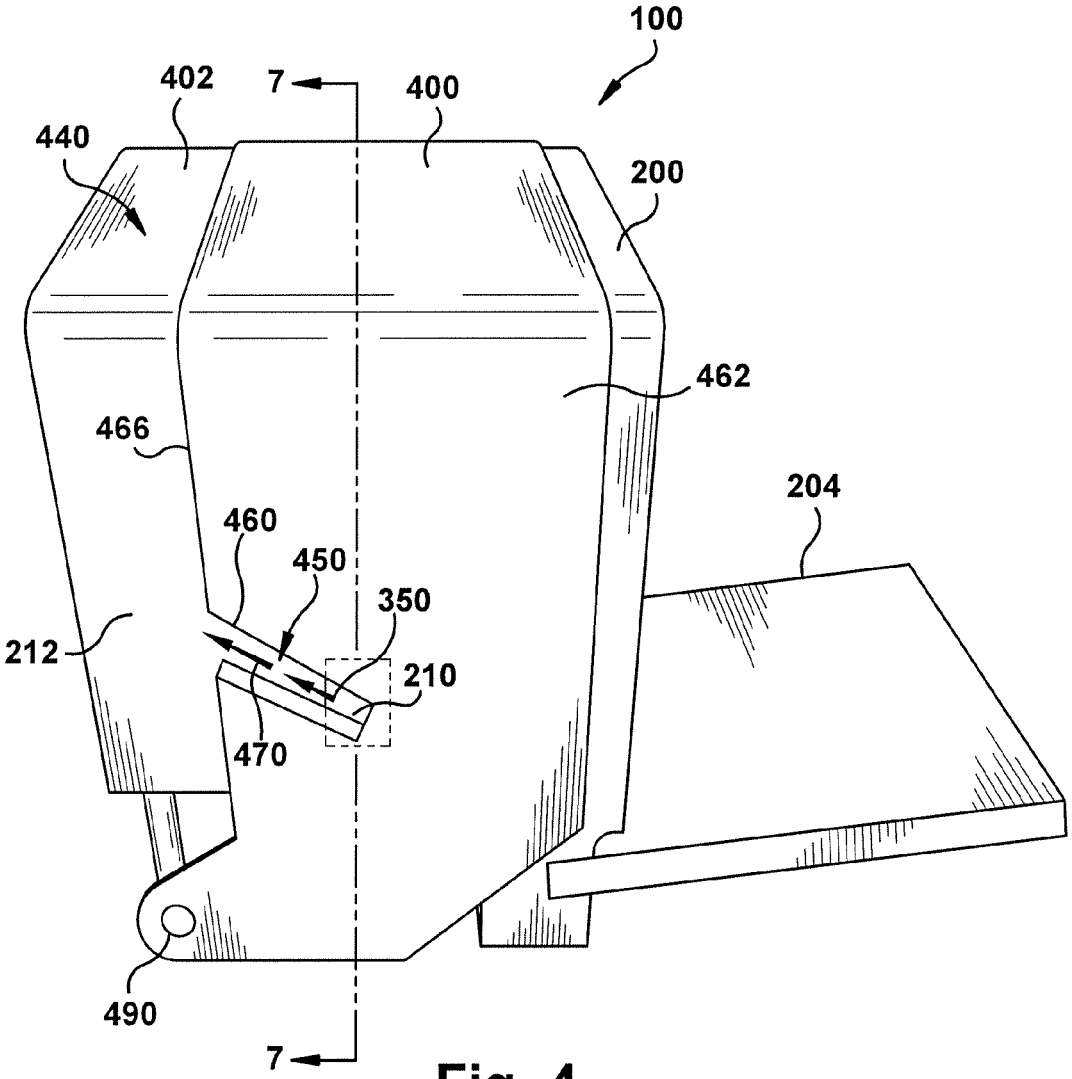
FIG. 4 is a perspective view of an exemplary embodiment of a dishwasher with an insulation blanket disposed on the tub.
Figure 8:
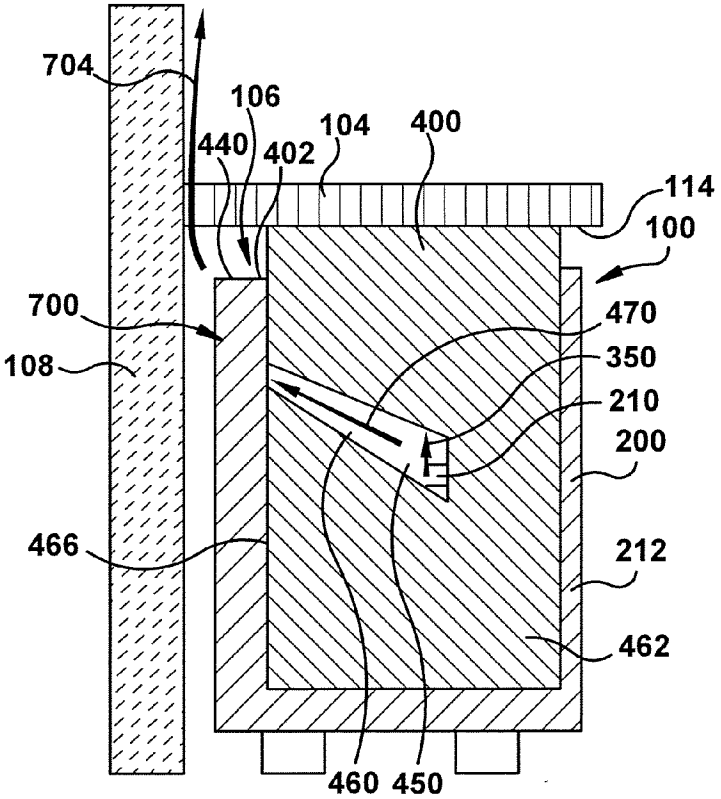
FIG. 8 is a sectional view taken along the plane indicated by lines 8-8 in FIG. 7.
Figure 7:
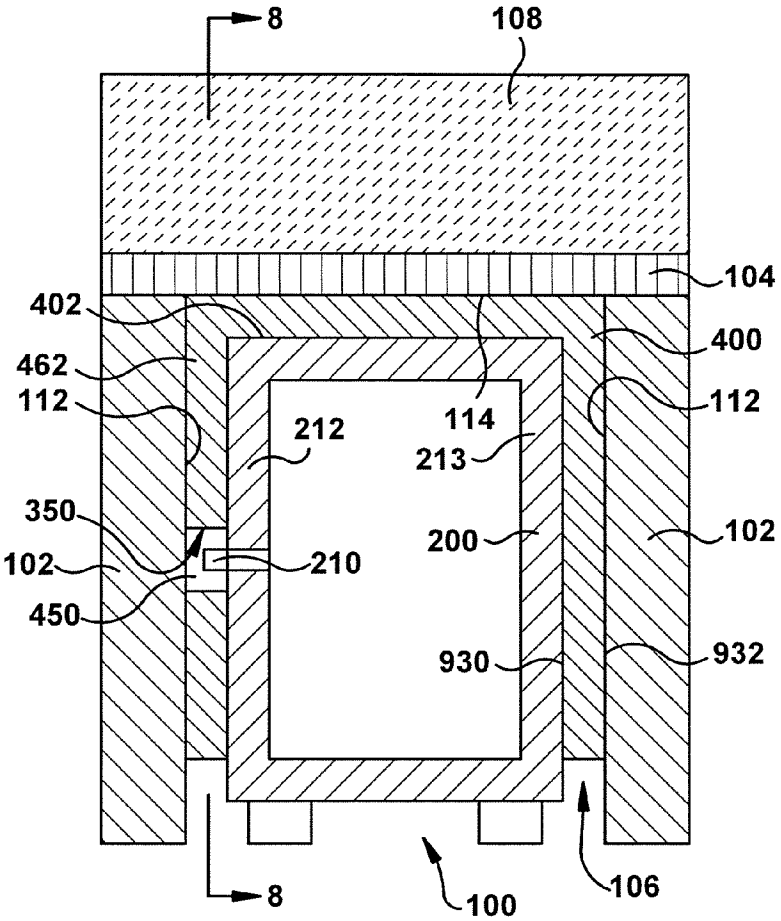
FIG. 7 is a sectional view taken along the plane indicated by lines 7-7 in FIG. 4 and also showing the cabinet and countertop.

Referring to FIGS. 4, 7, and 8, in one exemplary embodiment the blanket 400 is configured to provide a water vapor path 450. In an exemplary embodiment, the water vapor path 450 allows the water vapor to travel away from the vent 210 and away from the blanket 400. The water vapor path 450 thereby prevents the blanket from being substantially soaked with water. The water vapor path 450 can take a wide variety of different forms. In the example illustrated by FIG. 4, the water vapor path 450 is defined by a cut 460 through a side 462 of the blanket 400. The cut 460 can take a wide variety of different forms. In the example illustrated by FIG. 4, the cut 460 is a slot having a portion disposed over the vent 210 and that extends upward at an angle toward a back edge 466 of the blanket 400. Water vapor that exits the vent 210 follows the path 450 defined by the slot 460 as indicated by arrow 470.

Figure 6:
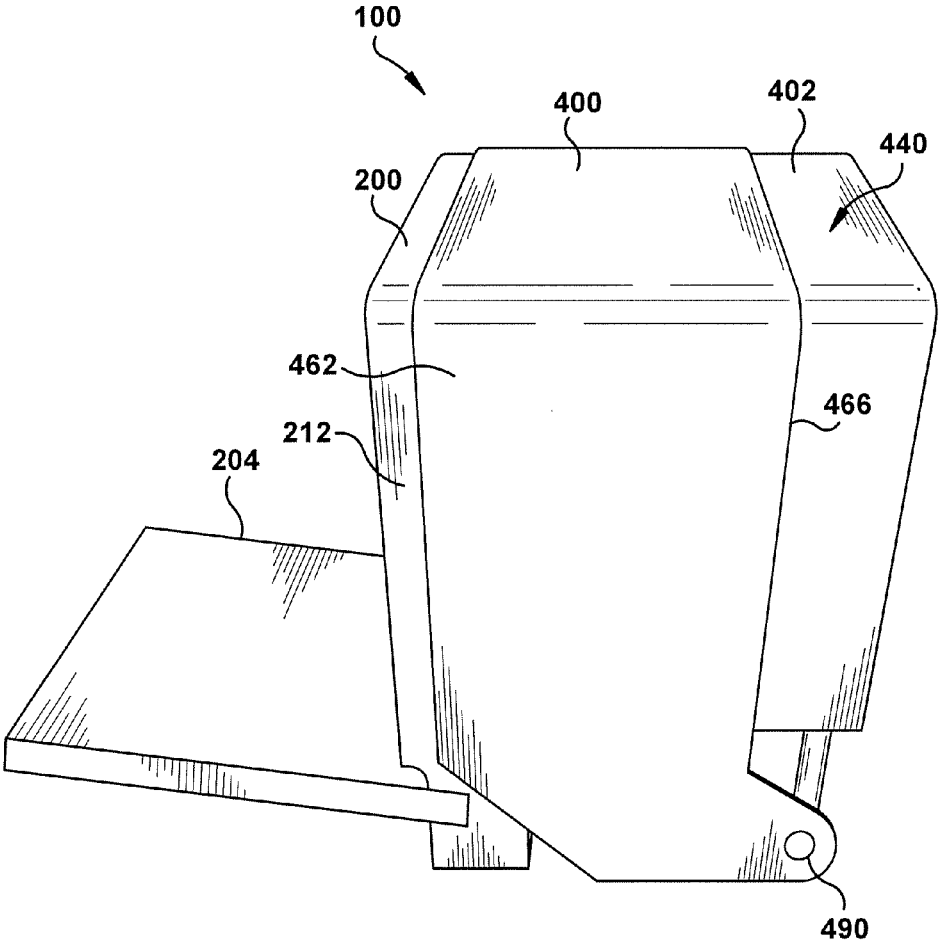
FIG. 6 is another perspective view of the dishwasher shown in FIG. 5.

FIG. 6 illustrates a second side of the dishwasher 100. In an exemplary embodiment, a vent or other area where water vapor can escape is not included on this sidewall 213. As such, a path 450 for water vapor 450 is not provided on this side. It should be apparent that a path 450 could be provided on this side if a source of water vapor were present.

Referring to FIGS. 7 and 8, in an exemplary embodiment, the water vapor moves from the path 450 to a space 700 that is behind the blanket 400, and between the tub wall 212 and the side 112 of the cabinet 102 as indicated by arrow 470. The water vapor may then move upward as indicated by arrow 704 and out of the cavity 106 between the wall 108 and the countertop 104 and/or through other gaps between the insulation 400 and the cavity 106 and/or between the insulation 400 and the tub 200. By allowing the water vapor to move away from the vent 210 and the blanket 400, the water vapor can escape the cavity 106 and/or is evenly dissipated. This escape and/or dissipation of the water vapor prevents localized areas of the blanket 400 or surfaces of the cavity 106 from becoming saturated with water.

Figure 5:
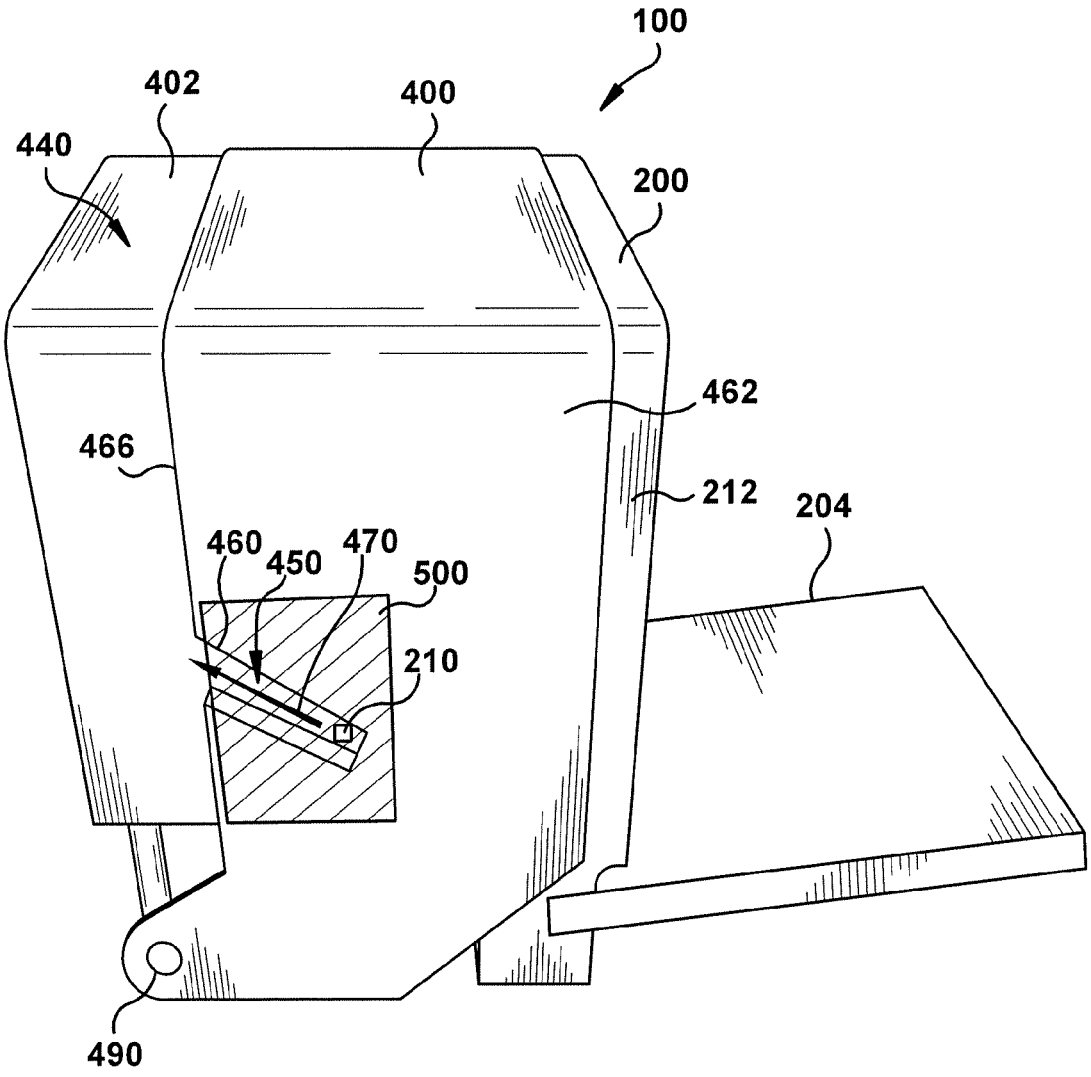
FIG. 5 is a perspective view of an exemplary embodiment of a dishwasher with an insulation blanket disposed on the tub.

FIG. 5 illustrates exemplary embodiments where a vapor barrier 500 is provided over the slot 460. The vapor barrier 500 prevents water vapor from condensing on the cabinet side 112 as the water moves along the path 450. The vapor barrier 500 can take a wide variety of different fauns. In one embodiment, the vapor barrier 500 is a tape. Materials that the vapor barrier can be made from include, but are not limited to, polymer facings, foils, paper type facings, fiberglass reinforced mats, EVA (ester vinyl acetate), rubber materials and highly filled layers of material around a reinforced web as well as mixtures thereof. Any type of vapor barrier can be used.

Figure 10:
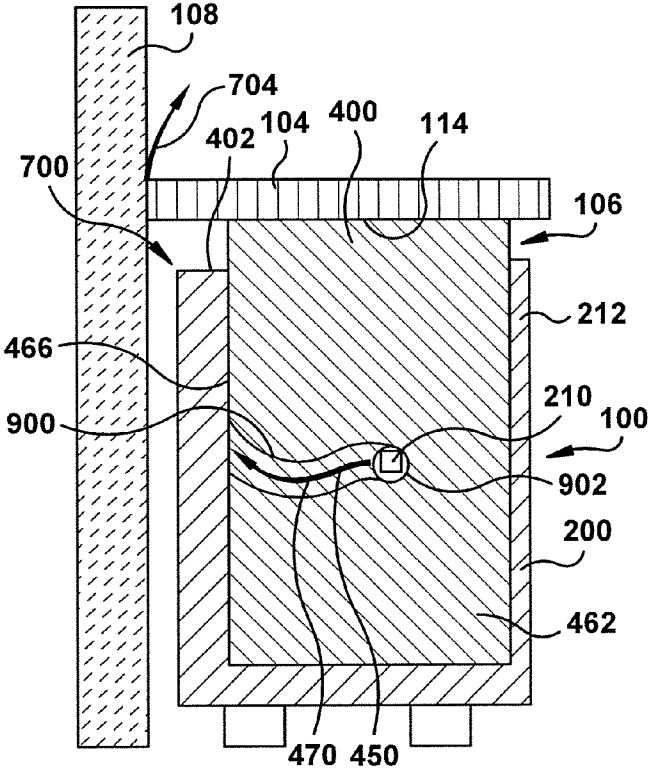
FIG. 10 is a sectional view taken along the plane indicated by lines 10-10 in FIG. 9.
Figure 9:
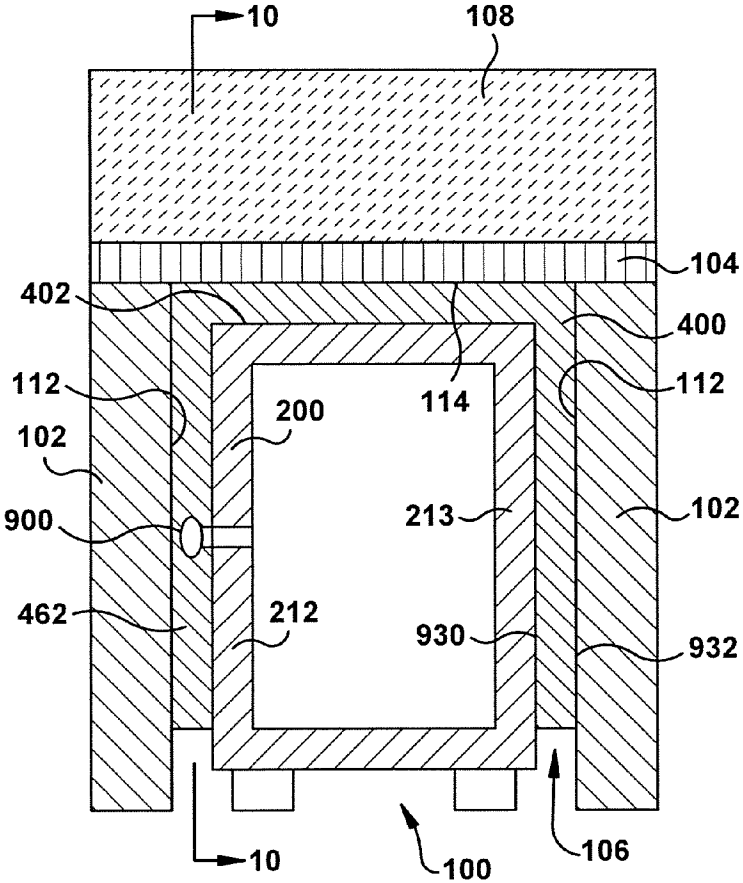
FIG. 9 is a view similar to FIG. 7 illustrating an alternate embodiment.

FIGS. 9 and 10 illustrate that the water vapor path 450 can be provided in manners other than the cuts illustrated by FIGS. 4, 5, 7, and 8. For example, in the example illustrated by FIGS. 9 and 10, the water vapor path is provided by a conduit 900. The conduit 900 can take a wide variety of different forms. In the example illustrated by FIGS. 9 and 10, the conduit 900 is disposed inside the blanket 400 and has an end 902 disposed over or in fluid communication with the vent 210. In another exemplary embodiment, the conduit 900 is disposed on an inside surface 930 of the blanket. In yet another embodiment, the conduit 900 is disposed on an outside surface 932 of the blanket and the end 902 extends through the blanket and over or in fluid communication with the vent 210. The water vapor conduit 900 allows the water vapor to travel away from the vent 210 and away from the blanket 400. The conduit 900 thereby prevents the blanket from being substantially soaked with water.

Referring to FIGS. 9 and 10, in an exemplary embodiment, the water vapor moves from the conduit 900 to the space 700 that is behind the blanket 400, and between the tub wall 212 and the side 112 of the cabinet 102. The water vapor may then move upward as indicated by arrow 704 and out of the cavity 106 between the wall 108 and the countertop 104 and/or through other gaps between the insulation 400 and the cavity 106 and/or between the insulation 400 and the tub 200. By allowing the water vapor to move away from the vent 210 and the blanket 400, the water vapor can escape the cavity 106 and/or is evenly dissipated. This escape and/or dissipation of the water vapor prevents localized areas of the blanket 400 or a surface of the cavity 106 from becoming saturated with water.

The water vapor path 450 can be provided in manners other than the cuts illustrated by FIGS. 4, 5, 7, and 8 and the conduit 900 illustrated by FIGS. 9 and 10. For example, in one embodiment, the blanket 400 may be provided with a facing 1100 on the side 930 closest to the tub 200 (See FIG. 11A). A spacer or other arrangement may be provided to provide a path 450 between the tub 200 and the facing. The facing 1100 is optional and a path 450 may be provided with spacers or other arrangements on a blanket that does not include a facing.

Figure 11A:
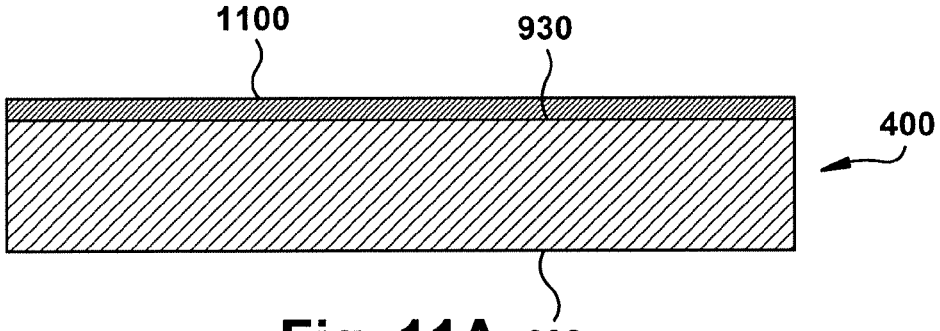
FIG. 11A is a sectional view of an insulation blanket having a vapor barrier on a side of the blanket that faces the dishwasher tub.
Figure 11B:
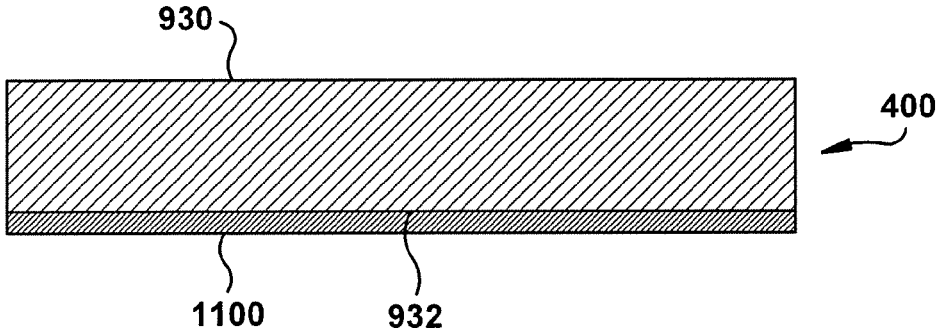
FIG. 11B is a sectional view of an insulation blanket having a vapor barrier on a side of the blanket that faces away from the dishwasher tub.
Figure 11C:
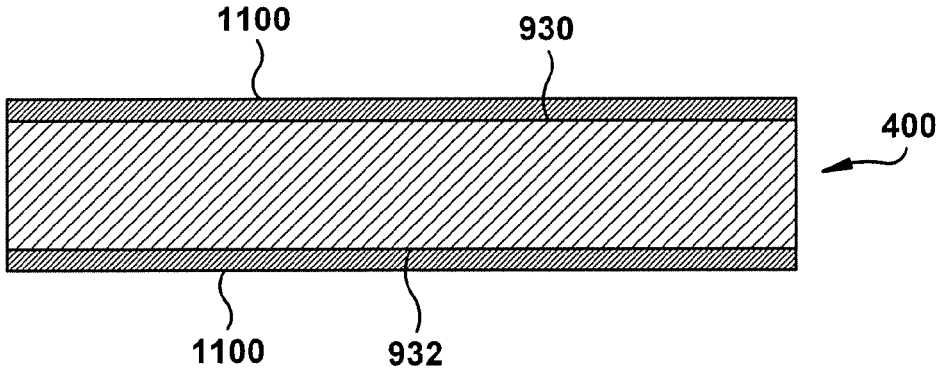
FIG. 11C is a sectional view of an insulation blanket having a vapor barrier on both sides.

FIGS. 11A-11C illustrate that any of the blankets 400 described in this application may be provided with a facing 1100. The facing 1100 may be provided on a side 930 that faces toward the tub 200 (FIG. 11A), the side 932 that faces away from the tub 200 (FIG. 11B), or both sides 930, 932 (FIG. 11C). The facing may take a wide variety of different forms. For example, the facing 1100 may be adhered to the blanket. For example, the facing 1100 may be a meltblown spunbond layer, or a polyethylene layer. In another exemplary embodiment, the facing 1100 is formed by heat densification. The heat densification may be accomplished in a variety of different ways. In one exemplary embodiment, the blanket 400 may be formed and/or the facing or densified layer may be formed in the manner disclosed by U.S. Pat. No. 6,726,980, which is incorporated herein by reference in its entirety.

Figure 12:
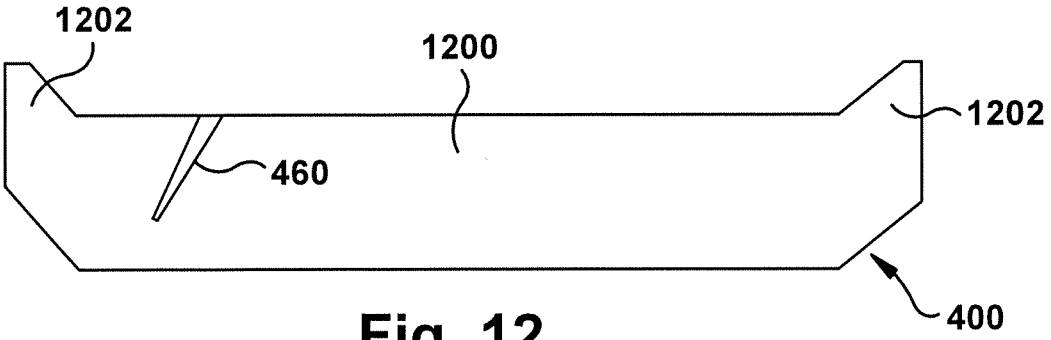
FIG. 12 is a plan view of a dishwasher blanket in a flat condition.

FIG. 12 illustrates a flat plan view of the insulation blanket 400 described with respect to FIGS. 4-6. The blanket illustrated by FIG. 12 (and in FIGS. 4-6) may or may not include the cut 460. In the embodiments illustrated by FIGS. 4-6 and 12, the blanket 400 is configured such that a rear portion 440 is uncovered by the blanket 400. The blanket 400 includes an elongated middle portion 1200 and two angled end portions 1202. The elongated middle portion 1200 is draped over the front of the top 402 and sides 212, 213 of the tub 200, leaving the rear of the top and sides uncovered. The two angled end portions 1202 extend rearward when installed on the tub 200 and allow the blanket to be attached to the lower, rear corners of the dishwasher 100 at attachment points 490.

Figure 13:
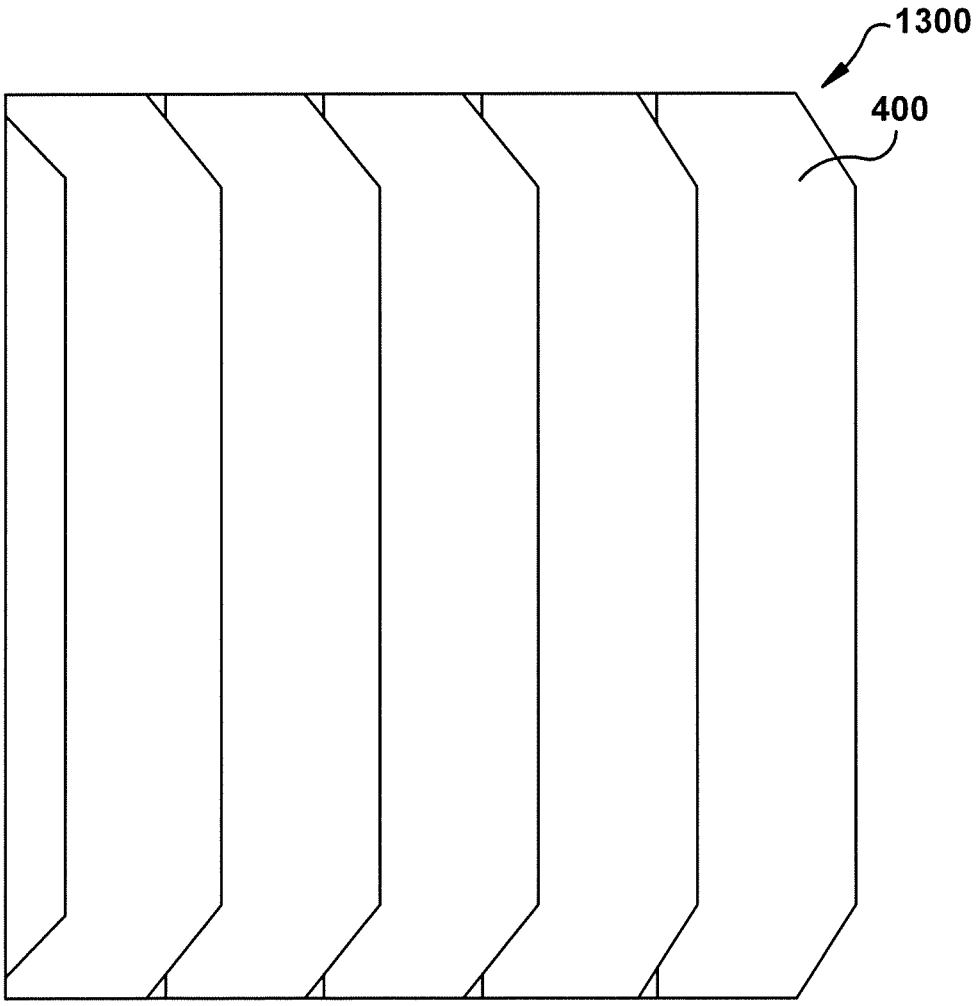
FIG. 13 illustrates how insulation blankets of FIG. 12 can be cut from a rectangular piece of insulation blanket.
Figure 14:
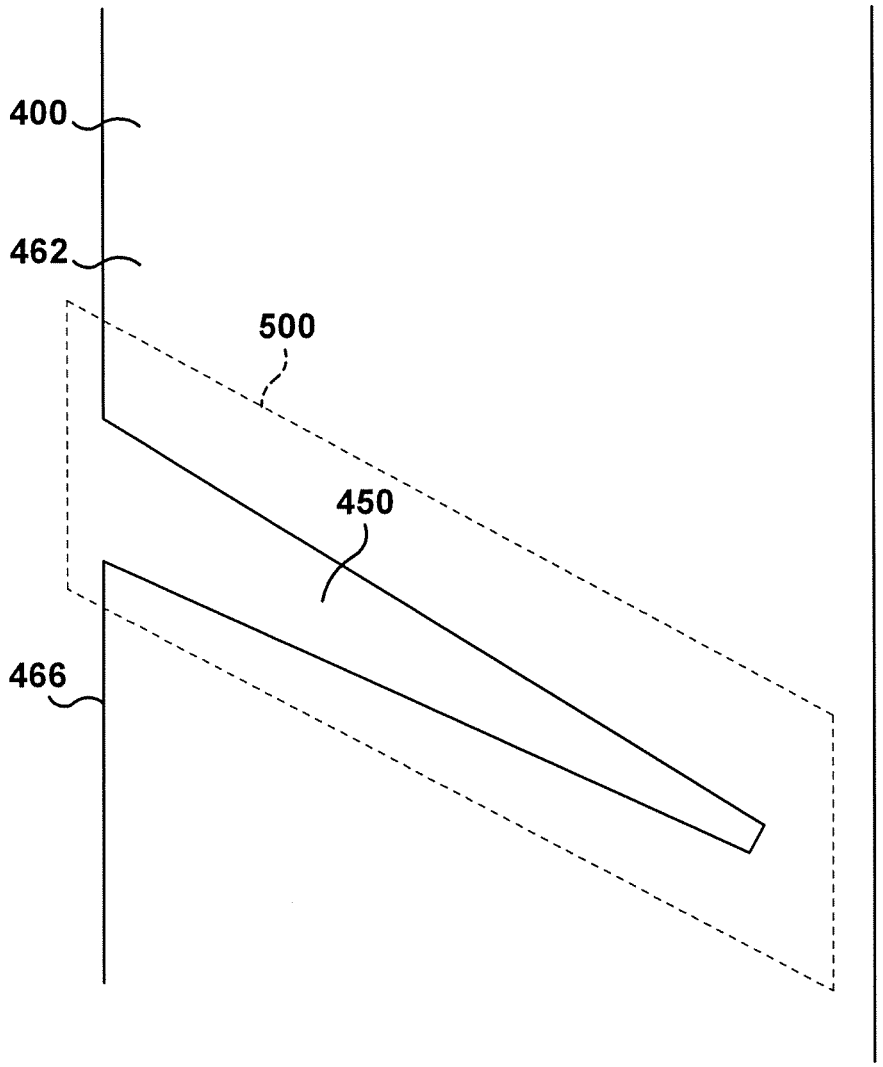
FIG. 14 illustrates a side of an insulation blanket with a venting cut with tape disposed over the cut.

FIG. 13 is a flat plan view of an array 1300 of insulation blankets 400 illustrated by FIG. 12. As can be seen by comparing FIGS. 13 and 18 (described in more detail below), the configuration illustrated by FIG. 12, where the rear 440 of the dishwasher 100 is not covered, allows more insulation blankets 400 to be cut out of a panel 1302. In addition, the configuration with the rear portion 440 not covered by the blanket 400 provides a large volume for dissipation of the water vapor.

Figure 15:
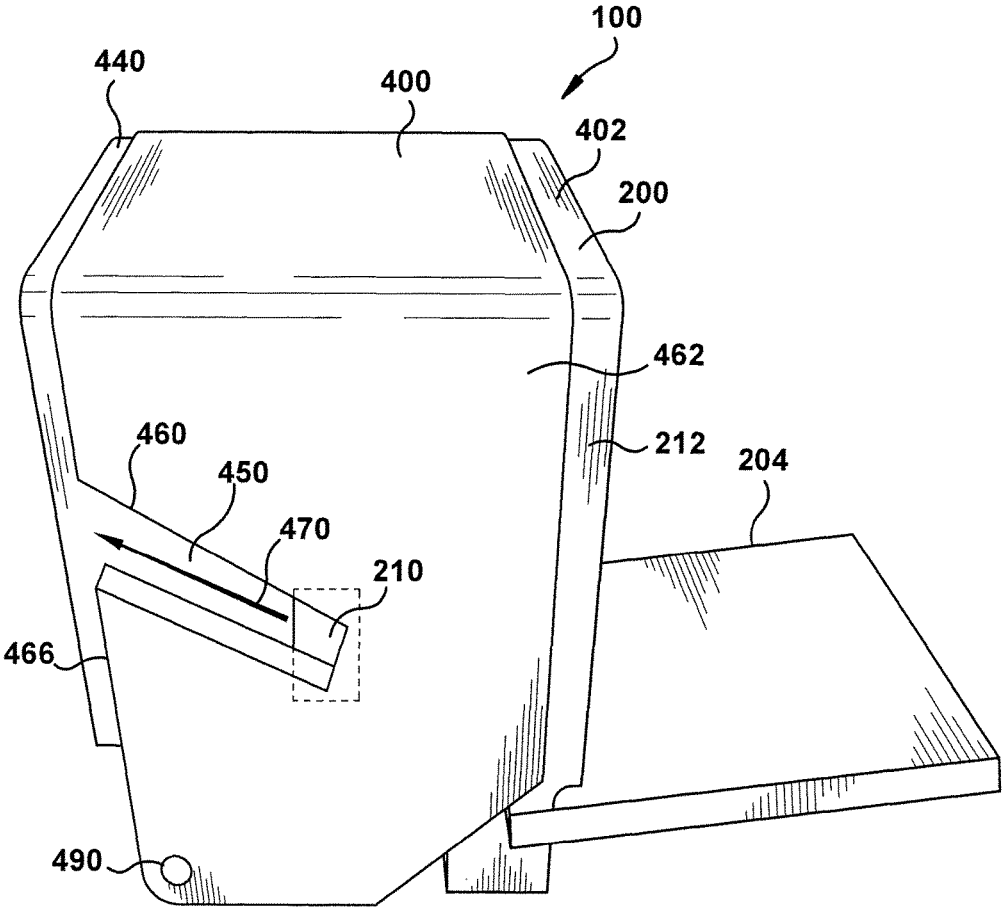
FIG. 15 is a perspective view of an exemplary embodiment of a dishwasher with an insulation blanket disposed on the tub.

FIG. 15 illustrates an exemplary embodiment that is similar to FIG. 4, except the blanket is sized and shaped to substantially cover all of the rear portion 440 of the tub 200. Referring to FIGS. 15, 7, and 8, in one exemplary embodiment the blanket 400 is configured to provide a water vapor path 450. In an exemplary embodiment, the water vapor path 450 allows the water vapor to travel away from the vent 210 and away from the blanket 400. The water vapor path 450 thereby prevents the blanket from being substantially soaked with water. The water vapor path 450 can take a wide variety of different forms. In the example illustrated by FIG. 15, the water vapor path 450 is defined by a cut 460 through a side 462 of the blanket 400. The cut 460 can take a wide variety of different forms. In the example illustrated by FIG. 15, the cut 460 is a slot having a portion disposed over the vent 210 and that extends upward at an angle toward a back edge 466 of the blanket 400. Water vapor that exits the vent 210 follows the path 450 defined by the slot 460 as indicated by arrow 470.

Figure 16:
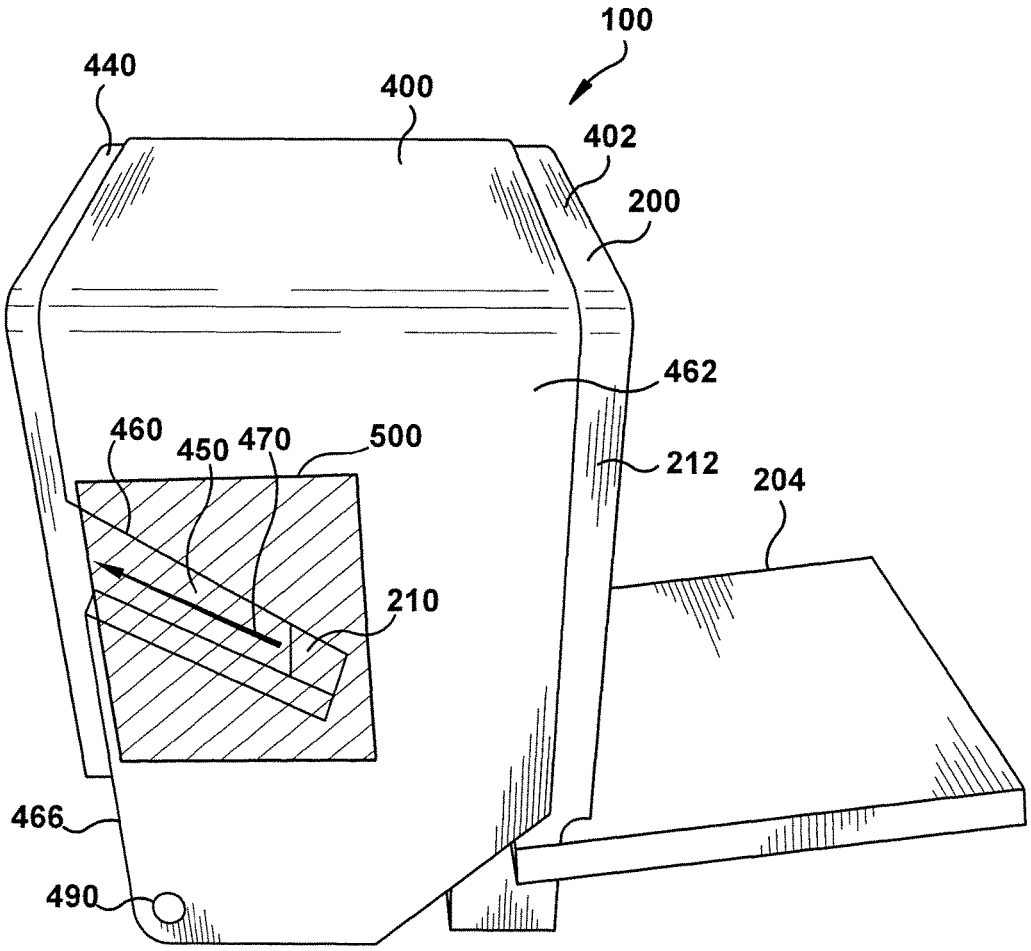
FIG. 16 is a perspective view of an exemplary embodiment of a dishwasher with an insulation blanket disposed on the tub.

FIG. 16 illustrates an exemplary embodiment where a vapor barrier 500 is provided over the slot 460. The vapor barrier 500 prevents water vapor from condensing on the cabinet side 112 as the water moves along the path 450. The vapor barrier 500 can take a wide variety of different forms. In one embodiment, the vapor barrier 500 is a tape. Materials that the vapor barrier can be made from include, but are not limited to, polymer facings, foils, paper type facings, fiberglass reinforced mats, EVA (ester vinyl acetate), rubber materials and highly filled layers of material around a reinforced web as well as mixtures thereof. Any type of vapor barrier can be used.

Figure 17:
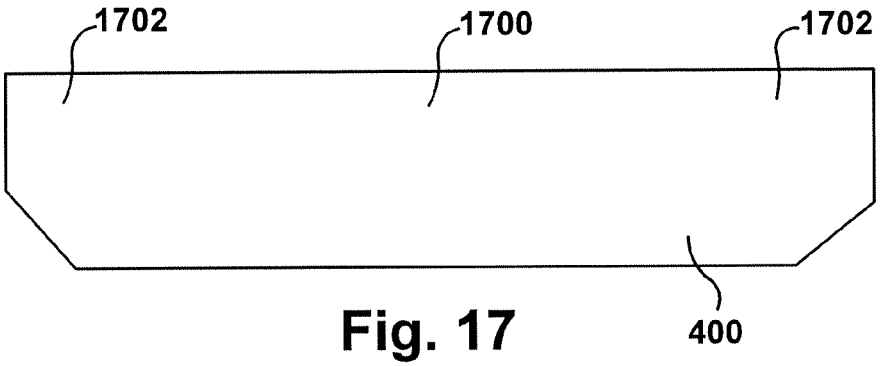
FIG. 17 is a plan view of a dishwasher blanket in a flat condition.
Figure 18:
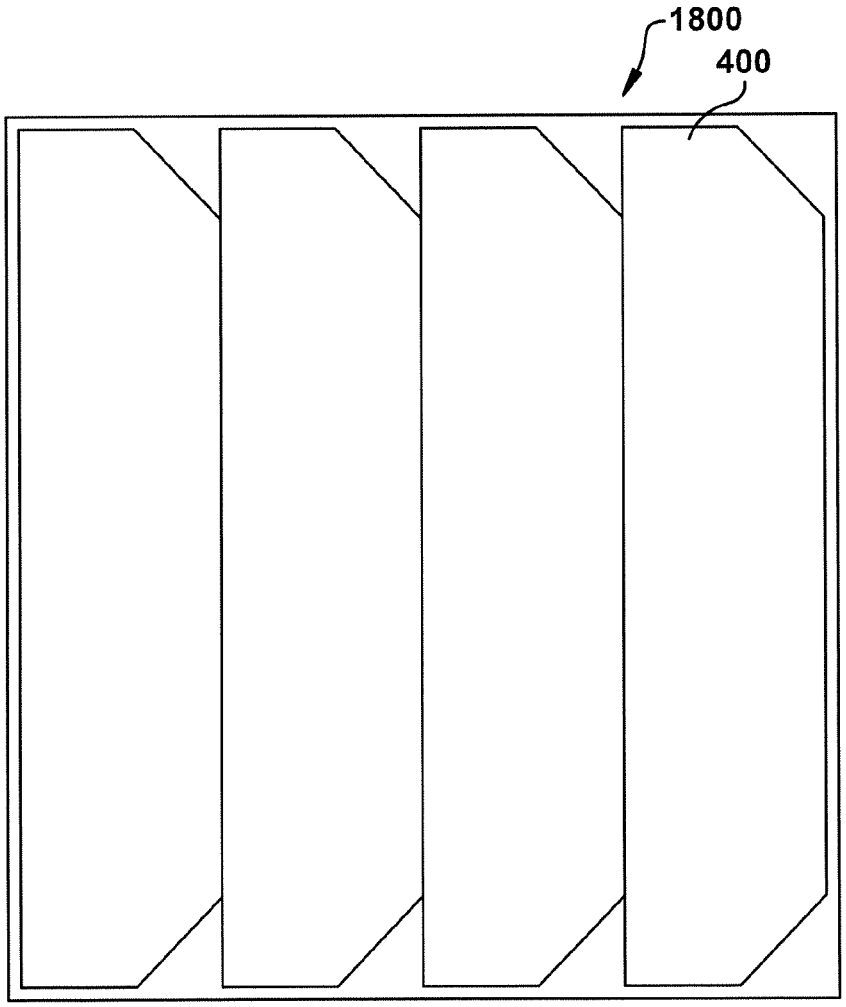
FIG. 18 illustrates how insulation blankets of FIG. 12 can be cut from a rectangular piece of insulation blanket.

FIG. 17 illustrates a flat plan view of the insulation blanket 400 described with respect to FIGS. 15 and 16. The blanket illustrated by FIG. 12 (and in FIGS. 4-6) may or may not include the cut 460. In the embodiments illustrated by FIGS. 15-17, the blanket 400 is configured such that a rear portion is covered by the blanket 400. The blanket 400 includes an elongated middle portion 1700 and two tapered end portions 1702. The elongated middle portion 1700 is draped over the top and sides of the tub 200, substantially covering them. The two tapered end portions 1702 are attachable to the lower, rear corners of the dishwasher 100 at attachment points 490. FIG. 18 is a flat plan view of an array 1800 of insulation blankets 400 illustrated by FIG. 17.

Figure 19:
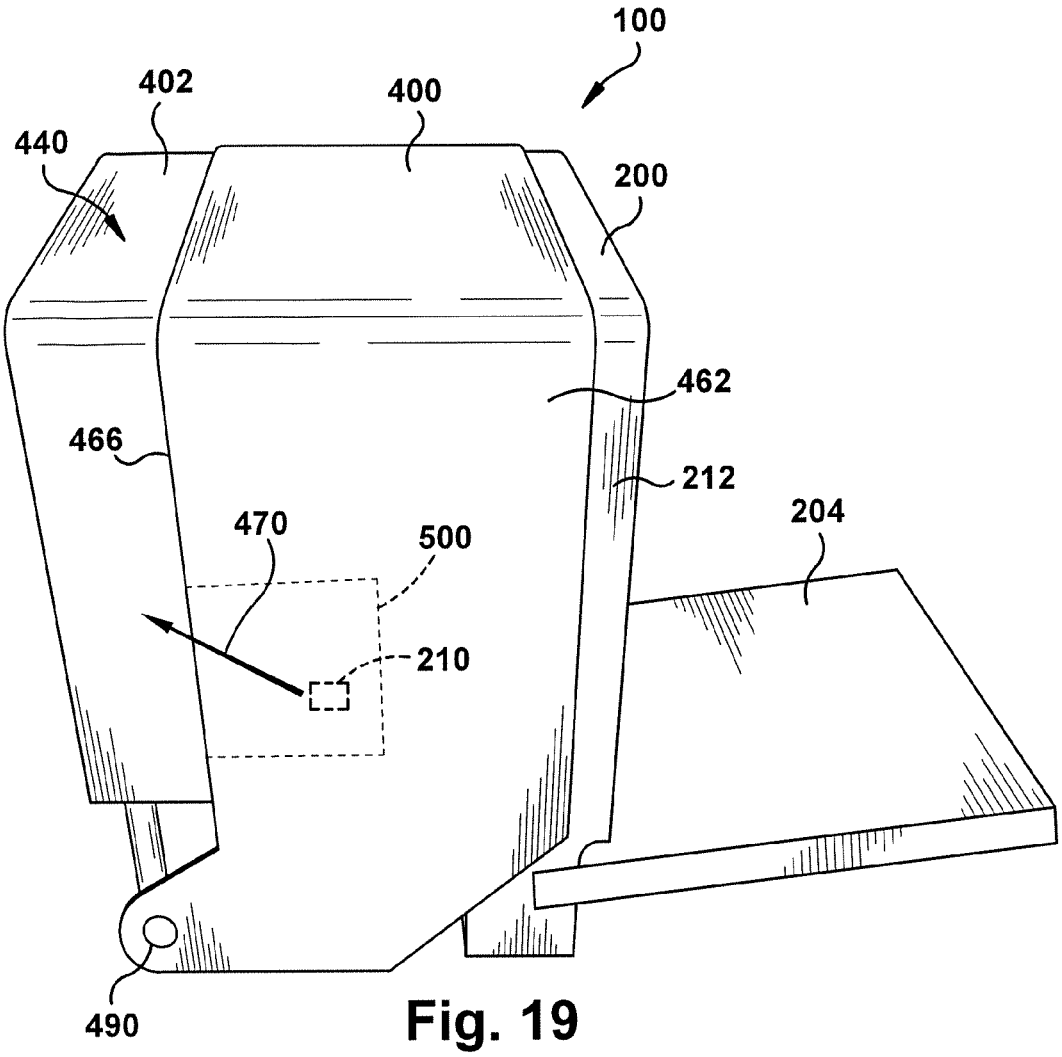
FIG. 19 is a perspective view of an exemplary embodiment of a dishwasher with an insulation blanket disposed on the tub.

Referring to FIG. 19, in one exemplary embodiment the blanket 400 is configured with a vapor barrier 500 positioned in the location of the vent 210 on the side of the blanket 400 that faces the sidewall 212 of the tub 200. In an exemplary embodiment, water vapor that exits the vent 210 escapes between the vapor barrier 500 and the sidewall 212 of the tub 200 in the direction indicated by arrow 470. The vapor barrier 500 thereby prevents the blanket 400 from being substantially soaked with water as water vapor leaves the vent 210. The vapor barrier 500 may be provided on the side of the blanket 400 that faces the sidewall 212 of the tub 200, or on both sides of the blanket 400. Alternatively, the vapor barrier 500 may be a sleeve that wraps around the blanket 400 (see for example, FIG. 20).

Figure 20:
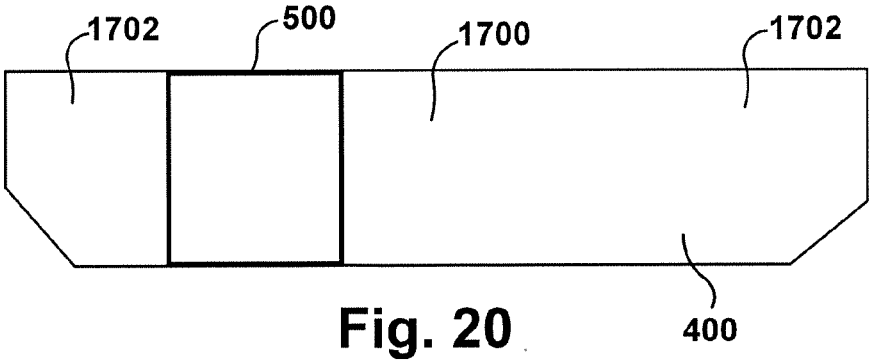
FIG. 20 is a plan view of a dishwasher blanket in a flat condition.

FIG. 20 illustrates a flat plan view of the insulation blanket 400 that is similar to FIG. 17, except that the vapor barrier 500 is provided with the blanket 400. The vapor barrier 500 is provided as a sleeve wrapped around the blanket 400 so that the vapor barrier 500 covers both sides of the blanket 400 in the location of the vent 210 when the blanket 400 is installed on the tub 200.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to any particular dishwasher. Thus, for example, use of the inventive concepts to both domestic and commercial dishwashers, are within the spirit and scope of the general inventive concepts. As another example, although the embodiments disclosed herein have been primarily directed to a dishwasher, the general inventive concepts could be readily extended to any unit which could benefit from the combination of the heating and insulating concepts disclosed herein. It is sought, therefore, to cover all such changes and modifications as fall within the spirit and scope of the general inventive concepts, as described and claimed herein, and equivalents thereof.

The invention claimed is:

1. A dishwasher, comprising:
a tub having a sidewall;
a vent attached to the sidewall;
an inlet line disposed outside the sidewall and attached to the vent for providing water to the tub through the sidewall;
an insulation blanket disposed over an outer surface of the tub sidewall and the vent; and
a water vapor path formed by a cut through a side of the insulation blanket that extends a length upward at an angle from the vent to at least an edge of the insulation blanket, wherein the water vapor path is a space between a vapor barrier on a side of the insulation blanket that faces toward the tub and the sidewall of the tub that faces toward the insulation blanket.

2. The dishwasher of claim 1, wherein the vent is an anti-backflow device.

3. The dishwasher of claim 1, wherein the insulation blanket comprises a facing.

4. The dishwasher of claim 3, wherein the facing is on a side of the insulation blanket that faces away from the tub.

5. The dishwasher of claim 3, wherein the facing is on a side of the insulation blanket that faces toward the tub.

6. The dishwasher of claim 1, wherein the vapor barrier is also provided on a side of the insulation blanket that faces away from the tub.

7. The dishwasher of claim 1, wherein the vapor barrier comprises a sleeve that wraps around the insulation blanket.

8. A dishwasher installation, comprising:
cabinets;
a countertop disposed on the cabinets;
wherein the cabinets and the countertop are arranged to form a dishwasher cavity;
a dishwasher disposed in the cavity, the dishwasher comprising:
a tub having a sidewall;
a vent attached to the sidewall;
an inlet line disposed outside the sidewall and attached to the vent for providing water to the tub through the sidewall;
an insulation blanket disposed over an outer surface of the tub sidewall and the vent; and a water vapor path formed by a cut through a side of the insulation blanket that extends a length upward at an angle from the vent to at least an edge of the insulation blanket wherein the water vapor path, wherein the water vapor path is a space between a vapor barrier on a side of the insulation blanket that faces toward the tub and the sidewall of the tub that faces toward the insulation blanket.

9. The dishwasher installation of claim 8, wherein the vent is an anti-backflow device.

10. The dishwasher installation of claim 8, wherein the insulation blanket comprises a facing.

11. The dishwasher installation of claim 10, wherein the facing is on a side of the insulation blanket that faces away from the tub.

12. The dishwasher installation of claim 10, wherein the facing is on a side of the insulation blanket that faces toward the tub.

13. The dishwasher installation of claim 8, wherein the water vapor path is a space between a vapor barrier on a side of the insulation blanket that faces toward the tub and the sidewall of the tub that faces toward the insulation blanket.

14. The dishwasher installation of claim 13, wherein the vapor barrier is also provided on a side of the insulation blanket that faces away from the tub.

15. The dishwasher installation of claim 13, wherein the vapor barrier comprises a sleeve that wraps around the insulation blanket.

16. A dishwasher, comprising:

a tub having a sidewall;

a vent attached to the sidewall;

an inlet line disposed outside the sidewall and attached to the vent for providing water to the tub through the sidewall;

an insulation blanket having a width disposed over an outer surface of the tub sidewall and the vent;

a water vapor path formed by a cut through the side of the insulation blanket that extends a length from the vent to at least an edge of the insulation blanket; and a vapor barrier disposed over said water vapor path, wherein the water vapor path is a space between the vapor barrier on a side of the insulation blanket that faces toward the tub and the sidewall of the tub that faces toward the insulation blanket.

* * * * *